United States Patent [19]

Shinomiya

[11] 4,132,157

[45] Jan. 2, 1979

[54] SCORER APPARATUS

[75] Inventor: Tsutomu Shinomiya, Iwatsuki, Japan

[73] Assignee: Kabushiki Kaisha Tomoku, Otaru, Japan

[21] Appl. No.: 807,343

[22] Filed: Jun. 16, 1977

[30] Foreign Application Priority Data

Jun. 24, 1976 [JP] Japan ..... 51-82093[U]
Jun. 24, 1976 [JP] Japan ..... 51-82094[U]
Jun. 24, 1976 [JP] Japan ..... 51-82095[U]

[51] Int. Cl.[2] ..... B26D 3/08
[52] U.S. Cl. ..... 93/58.1; 93/58.2 R
[58] Field of Search ..... 83/498, 499, 500–504; 93/58.1, 58.2 R, 58.2 F, 58 R, 58.4

[56] References Cited

U.S. PATENT DOCUMENTS 3,147,676 9/1964 Sheeran ..... 93/58.1
3,882,764 5/1975 Johnson ..... 83/499 X
3,929,047 12/1975 Brandl ..... 93/58.1 X
4,033,217 7/1977 Flaum et al. ..... 93/58.2 R X

*Primary Examiner*—James F. Coan
*Attorney, Agent, or Firm*—Haseltine, Lake & Waters

[57] ABSTRACT

A scorer apparatus where a pair of driving shafts are disposed and below a sheet of corrugated cardboard or the like, separatable one from another provided with at least two pairs of mutually facing scorer members slidable in the axial direction to enable the sheet-like member to be applied thereon with score lines. Driving shafts are provided with plural moving shafts and each of the plural moving shafts on one side is connected to each corresponding one of the plural moving shafts on the other side through electrically driven shafts. Shifter members engage respective scorer members on each side and are in threaded engagement with each corresponding pair of moving shafts.

1 Claim, 5 Drawing Figures

SCORER APPARATUS

BACKGROUND OF THE INVENTION

This invention relates to a scorer apparatus for forming score lines in the surface of a sheet-like member such as a sheet of corrugated cardboard or the like.

In general, such apparatus has been hitherto known that a pair of driving shafts provided above and below a sheet-like member are provided with plural pairs of mutually facing scorer members so mounted thereon as to be slidable along the axial directions thereof. The score lines are then formed on the sheet-like member passing between the scorer members. This conventional apparatus, however, has a number of defects such as: when the scorer members are moved for adjustment with the number of pairs of scorer members changing according to the spacing of the score lines desired to be obtained, the scorer members are liable to be inclined, so they do not face one another accurately, and thus the score members are damaged or the score lines are curved.

Additionally, it has been usual with this conventional apparatus that when movement of the scorer members is intended, respective upper and lower scorer members are separately moved to a predetermined position along respective driving shafts. In turn, it has been essential that respective electric motors are provided for the driving shafts and in turn electric motors are provided for the respective scorer members. It follows that with this kind of prior art arrangement a large number of electric motors are required and the apparatus becomes costly and complicated to control and operate.

SUMMARY OF THE INVENTION

According to the invention, a scorer apparatus of the type that a pair of driving shafts disposed above and below a sheet-like member such as a sheet of corrugated cardboard or the like, so as to come apart one from another are provided with at least two pairs of mutually facing scorer members so mounted thereon as to be slidable along the axial directions. The sheet-like member may be applied thereon with score lines, whereby the driving shafts are each provided with plural moving shafts arranged in parallel with a driving shaft, and each of the plural moving shafts on one side are each connected to associated plural moving shafts on the other side through each corresponding one of connecting shafts driven by respective electric motors. Respective shifter members are engaged with the respective scorer members on each side and are mounted on the plural moving shafts on the same side, and each pair of shifter members for each pair of the mutually facing scorer members on both sides are in threaded engagement with each corresponding pair of the moving shafts.

A further feature of this invention, employs connecting shafts each constructed that the same can be expanded and contracted, and one of the two driving shafts is connected to a main driving shaft through another connecting shaft which is also so constructed that the same can be expanded and contracted. In order that the shifter members may be moved more accurately without fluctuation movement, two driving shafts each has a guide rail, disposed in parallel therewith, and the shifter members each have a pair of elongated boss portions projecting therefrom being in slidable engagement at the boss portions with the opposite lateral surfaces of the guide rail, and each boss portion has on its one end a recess and on its other end a projection of such a size that the same can be inserted in the recess.

The main object of the present invention is to avoid the defects of the prior art.

Still another object of the present invention is to provide a scorer apparatus employing a shaft arrangement with shifter members for positioning the apparatus with respect to the material to be scored.

Other objects and advantages of the present invention will be explained with reference to the accompanying drawings:

IN THE DRAWINGS

PREFERRED EMBODIMENTS OF THE INVENTION

Figure 2:
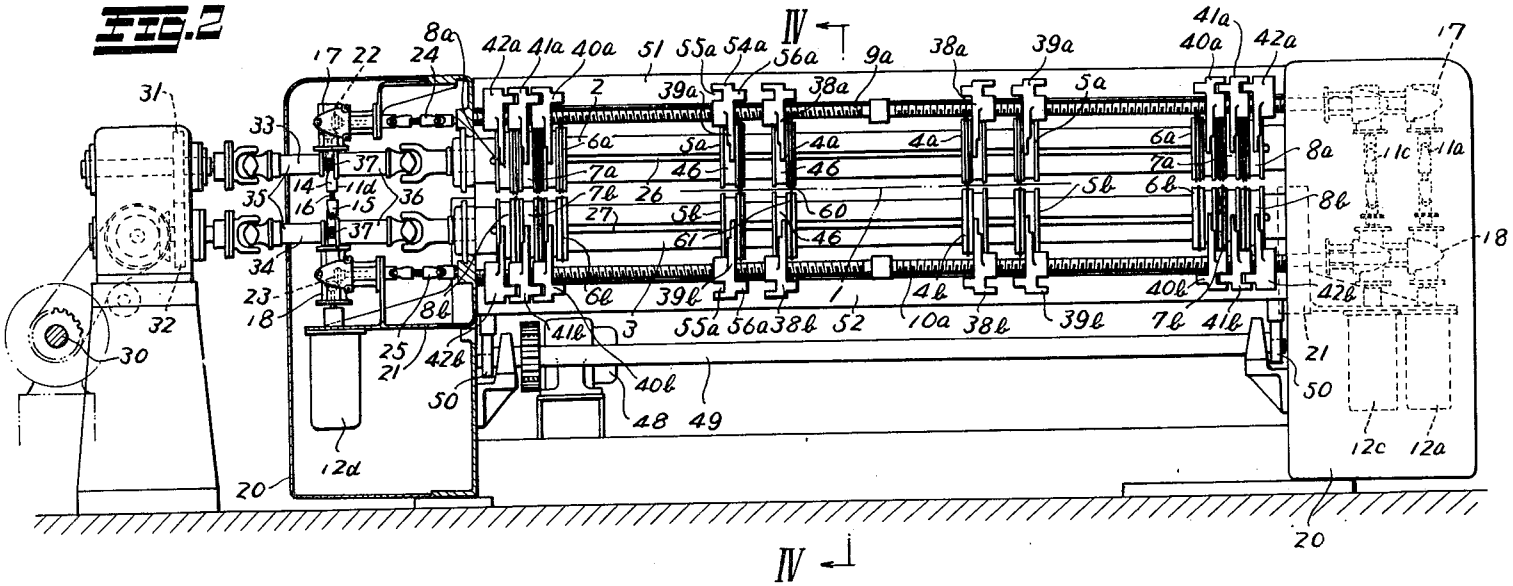
FIG. 2 is a detailed sectional view of FIG. 1 along line II—II.

According to FIG. 2 a sheet-like member 1 such as a sheet of corrugated cardboard and a pair of driving shafts 2, 3 provide passage above and below for the sheet-like member 1. The upper driving shaft 2 is supported on stationary machine frames 20, 20 provided on both end portions thereof, and the lower driving shaft 3 is supported on movable machine frames 21, 21 provided on the stationary machine frames 20, 20 as to be movable upwards and downwards. These two driving shafts 2, 3 are provided with pairs of mutually facing scorer members that is, ten pairs thereof 4*a*, 5*a* . . . and 4*b*, 5*b* . . . , for instance, disposed in such a manner that they are slidably mounted on the shafts 2, 3. The ten pairs are so disposed thereon that, five pairs 4*a*, 5*a* . . . 8*a* and 4*b*, 5*b* . . . 8*b* are on the left and five pairs 4*a*, 5*a* . . . 8*a* and 4*b*, 5*b* . . . 8*b* are on the right so that those may be symmetrical one with another.

Each scorer member on the upper side, that is, the scorer member 4*a*, for instance, has on its periphery two ridges 60, 60, while each scorer member on the lower side, that is, the scorer member 4*b*, for instance, has on its periphery a single ridge 61. The pair of the upper and lower scorer members 4*a*, 4*b* are arranged to come near one to another to such an extent that the ridge 61 may go in between the two ridges 60, 60. If, under this condition, the sheet-like member 1 is passed therebetween, a single scorer line is formed thereon by those ridges 60, 60, 61.

Moving shafts 9*a*–9*e* of screw rod form which are supported on stationary machine frames 20, 20 so as to be in parallel with the upper driving shaft 2. Moving shafts 10*a*–10*e* of screw rod form are supported on the movable machine frames 21, 21 so as to be in parallel with the lower driving shaft 3. Each of the driving shafts 2, 3 is provided on its outside with one group of moving shafts comprising at least two moving shafts.

Figure 1:
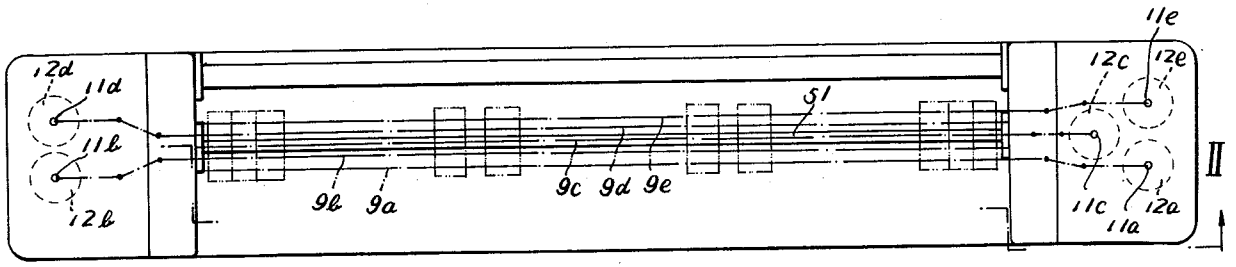
FIG. 1 is a top view in schematic form illustrating the shafts employed in the present invention.

According to FIG. 1, each of the moving shafts 9*a*–9*e*, which form one of the two groups, is connected to each corresponding one of the moving shafts 10–10*e*, which form the other of the two groups, through each corresponding one of rotary connecting shafts 11*a*–11*e*, each of which is so constructed that the same can be expanded and contracted. The connecting shafts 11a–11e each comprises, for instance, tubular spline shafts 14, 15 on its opposite ends and an intermediate spline shaft 16, so that its expansion and contraction movements can be effected in such a manner that the spline shafts 14, 15 come near one to another or come apart one from another along the spline shaft 16.

The connecting shafts 11a–11e each is inserted at its opposite end positions in a holder 17 fixed to the stationary machine frame 2 and a holder 18 fixed to the movable machine frame 21, respectively, and thus the same shafts 11a–11e each is connected to each pair of the upper and lower moving shafts 9a, 10a, for instance, through each pair of bevel gears 22, 23 provided in each of the holders 17, 18 and through respective rotary couplings 24, 25. Couplings 24, 25 each is associated with each of the foregoing shafts 11a–11e. The connecting shafts 11a–11e are arranged to be rotated by respective electric motors 12a–12e provided on the movable machine frames 21, 21 and thus if the connecting shafts 11a, 11b, for instance, are rotated by the respective electric motors 12a, 12b, the moving shafts 9a, 9b and 10a, 10b connected to the connecting shafts 11a, 11b are simultaneously rotated.

Figures 3, 4, 5:
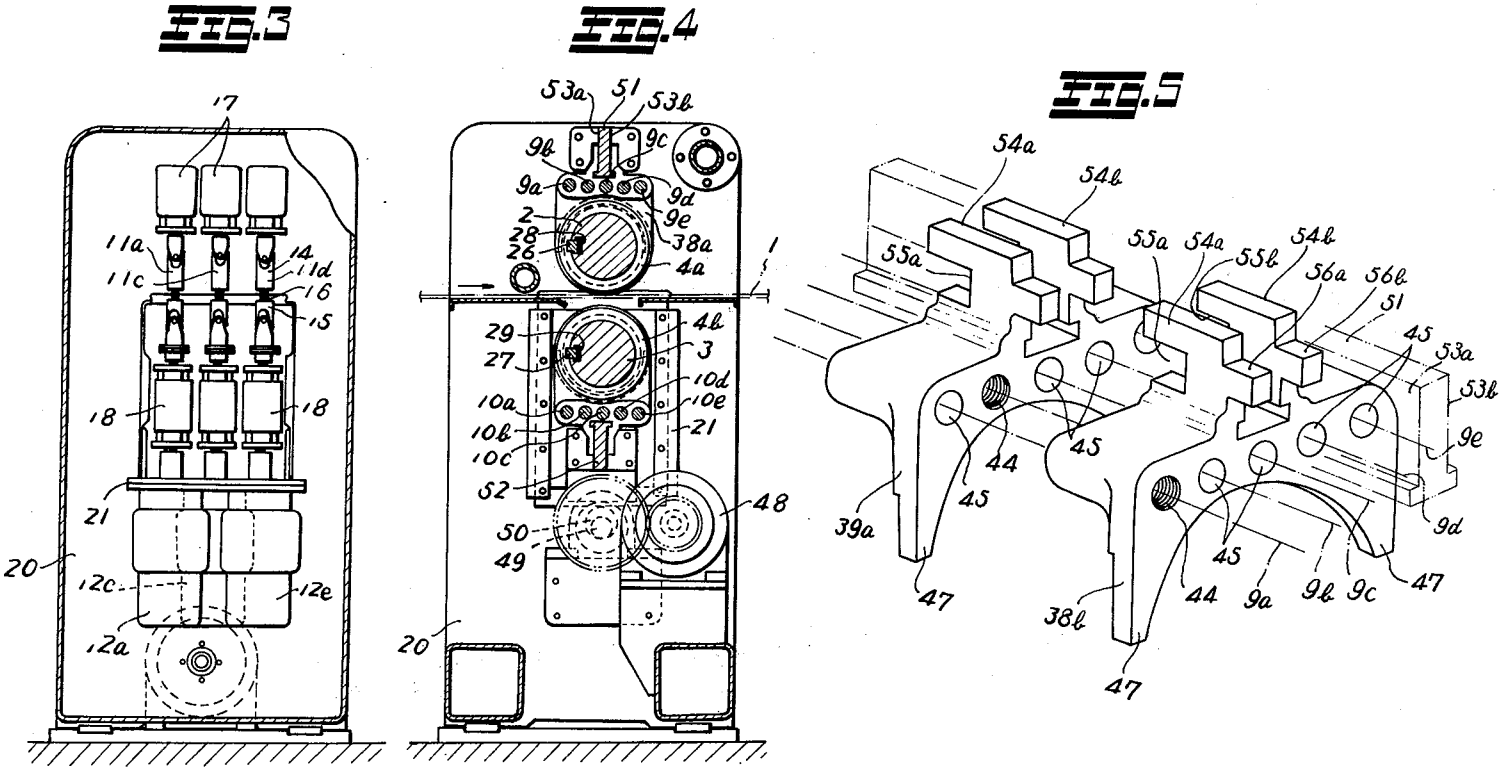
FIG. 3 is a partially fragmented end view of the right side of FIG. 2
FIG. 4 is a sectional view of FIG. 2 taken along IV—IV.
FIG. 5 is an exploded view of shifter member of the invention.

As shown in FIG. 4, the driving shafts 2, 3 are provided with respective long keys 26, 27 which protrude therefrom and retreat therein so that if pressure air acts in respective flexible tubes 28, 29 provided inside the same, the keys 26, 27 are projected for being in engagement with key grooves made in the scorer members 4a, 4b, 5a, 5b . . . .

A main driving shaft 30 is arranged to be rotated by a driving source such as an electric motor or the like, and gears 31, 32 are rotated in reverse direction one to another by the main driving shaft 30, and respective shafts having gears 31, 32 are connected to the foregoing driving shafts 2, 3 through respective connecting shafts 33, 34, each being of the type that the same can be expanded and contracted. In almost the same manner, as in each of the connecting shafts 11a–11e, the connecting shafts 33, 34 each comprise tubular spline shafts 35, 36 on its opposite ends and an intermediate spline shaft 37, and thus the driving shaft 3 can be moved downwards to separate from the driving shaft 2, while being rotated.

The thread formed in each of the moving shafts 9a–9e, 10a–10e comprises right-hand and left-hand ones on the right half and the left half thereof.

In FIG. 5, shifter members 38a, 39a . . . 42a, 38b, 39b . . . 42b, are respectively in engagement with the foregoing scorer members 4a, 5b . . . , and are disposed in accordance with the distribution of respective scorer members. Each of the upper side shifter members 38a, 39a . . . and each of the lower side shifter members 38b, 39b . . . are so provided that they are all mounted on all of the upper moving shafts 9a–9e and on all of the lower moving shafts 10a–10e respectively. The upper shifter members 38a, 39a, for instance, are so provided that the same are, respectively, mounted on all the upper moving shafts 9a–9e. Each shifter member has a threaded opening 44, which is in threaded engagement with one of the moving shafts, and through openings 45 . . . which are freely mounted on the remainder moving shafts.

Each pair of shifter members 38a and 38b, 39a and 39b and others are in threaded engagement with each pair of moving shafts 9a and 10a, and 9b and 10b, and others interconnected through each of the connecting shafts 11a, 11b and others. Thus any pair of shifter members cannot be moved so far as any corresponding pair of moving shafts which are in threaded engagement therewith and are not rotated. Each moving shaft has its thread which is reverse in direction on the right half and the left half as mentioned before, so that if the pair of upper and lower moving shafts 9a, 10a interconnected through the connecting shaft 11a, for instance, are rotated by the electric motor 12a, the pair of shifter members 38a, 38b on the left side which are in threaded engagement with the shafts 9a, 10a and the pair of shifter members 38a, 38b on the right side disposed symmetrically therewith are moved symmetrically one with another. Namely, when the shifter members on one side are moved inwards, the two shifter members on the other side are also moved inwards simultaneously.

Each shifter member has an arc-shaped claw member 47 which is in engagement with an engaging groove 46 formed circumferentially on the periphery of each scorer member, so that if each shifter member is moved, each corresponding scorer member is moved thereby to slide on the driving shaft.

An electric motor 48 is provided on the stationary machine frame 20 and an output shaft 49 is driven to rotate by the same and is provided with a pair of cams 50 which are in contact with the lower surfaces of the movable machine frames 21, so that if the cams 50 are turned by the electric motor 48, the movable machine frames 21 are moved upwards and downwards in relation to the stationary machine frames 20 and thus the lower scorer members 4b, 5 . . . come near to and apart from the upper scorer members 4a, 5a . . . .

Guide rails 51, 52, each of which is nearly T-shaped in section, are provided in parallel with the respective driving shafts 2, 3, and elongated boss portions 54a, 54b projecting from each shift member are in slidable contact with both side surfaces 53a, 53b of each guide rail 51 or 52 as shown clearly in FIG. 5. The boss portions 54a, 54b have recesses 55a, 55b on one end and on the other end thereof projections 56a, 56b of such a size that the same can mount in the recesses 55a, 55b. When each shifter member is moved, the elongated boss portions 54a, 54b which are in slidable contact with the opposite side surfaces of the guide rail 51 or 52 can serve to prevent the shift member from being inclined. The two shift members adjacent one with another, for instance, 10a, and 10b, can be mated with another at the recesses 55a, 55b and the projections 56a, 56b. Thus, the distance between the two adjacent shift members 10a, 10b can become small, whereby scorer lines of a comparatively small spacing can be formed on the sheet-like member 1.

An operation of the apparatus is explained as follows:

Electric motor 48 is energized to turn the cams 50, 50, whereby the movable machine frames 21, 21 are lowered for separating the upper scorer members 4a, 5a . . . and the lower scorer members 4b, 5b . . . one from another. At the same time, flexible tubes 28, 29 are not pressurized air, so that the keys 26, 27 may be free to move to protrude and retreat and thus the scorer members are now slidable along the driving shafts 2, 3.

When any desired pair of scorer members are intended to be moved, that is, the pair of members 4a, 4b, for instance, the moving shafts 9a, 10a which are in threaded engagement with the shifter members 38a, 38b, which are in engagement with the foregoing scorer members 4a, 4b are rotated in one direction or in another direction by the electric motor 12*a*. Thereby, the two shifter members 38*a*, 38*b* on the left side and the two shifter members 38*a*, 38*b* on the right side which are symmetrical with one another, are moved to the right and the left along the moving shafts 9*a*, 10*a* and the guide rails 51, 52. Scorer members 4*a*, 4*b* which are engaged with the shifter members 38*a*, 38*b* through the claw members 47, 47 are moved to the right and the left on the driving shafts 2, 3. If the scorer members 4*a*, 4*b*, for instance, are completed to move to the desired positions, the electric motor 12*a* is stopped and the flexible tubes 28, 29 are in turn pressurized with air for fixing the scorer members 4*a*, 4*b* on the driving shafts 2, 3 by means of the keys 26, 27. Then, the cams 50, 50 are rotated until the driving shaft 3 again comes near the driving shaft 2.

Thus, the moving operation for the scorer members is completed. If, then, the driving shafts 2, 3 are rotated by turning of the main driving shaft 30, predetermined score lines can be formed on the sheet-like member 1 passing between those scorer members.

It is also possible to drive the other electric motors 8*b*, 8*c*, 8*d*, 8*e* simultaneously in order that the other pairs of scorer members are also simultaneously moved.

Thus, according to this invention, at least two moving shafts are provided in parallel with each driving shaft, and shifter members are so prepared that these may be mounted on these moving shafts and each shift member is in threaded engagement with any one of these moving shafts. It then becomes possible for each shifter member to move each scorer member without being inclined because the remainder moving shafts which are not in threaded engagement therewith serve as guide rods. Additionally, each pair of the upper and the lower moving shafts are interconnected and are connected to a single common electric motor, so that the number of the electric motors for driving the moving shafts can be decreased and the apparatus can be produced at a low price. Additionally any corresponding ones of the upper and the lower moving shafts can be operated synchronously and thus the scorer members can be moved accurately.

ALTERNATE EMBODIMENT OF THE INVENTION

According to the second feature of this invention, the connecting shafts between the upper and lower moving shafts and the connecting shaft between the driving shaft and the main driving shaft are so constructed that the same may be expanded and contracted. It follows that the moving shafts and the driving shaft can be rotated regardless of any distance of between the driving shafts, and it becomes possible to have any desired adjustment in the spacing of the scorer members according to the thickness of the sheet-like member.

Also, the guide rail is provided along each driving shaft and each shift member is in slidable contact with the same at its elongated boss portions having recesses and projections, so that each shift member can be further prevented from being inclined and thereby the scorer members can be moved more accurately. Additionally, the shift members adjacent to one another can be mounted together at the recesses and the projections, so that the interval between the adjacent shifter members can be minimized and consequently score lines closed one to another can be formed in the sheet-like member. The scorer members not used can be set aside compactly on the right side and the left side of the driving shafts and thus the apparatus can be small in size.

Many modifications and variations of the present invention are possible in light of the above teachings. It is, therefore, to be understood that within the scope of the appended claims, the invention may be practiced otherwise than as particularly described.

What I claim is:

1. An improved scorer apparatus employing a pair of driving shafts disposed above and below a sheet of material, such as corrugated cardboard, said shafts being separable one from another and being provided with at least two pair of oppositely facing scorer members symmetrically mounted thereon and being slidable in an axial direction for applying score lines to said cardboard; driving shaft means having a plurality of moving shaft means arranged in parallel with said driving shaft means and being connected to a main driving shaft through another connecting shaft means adapted to be axially expanded and contracted; said plurality of moving shaft means being disposed to form co-acting pairs and being connected through to connecting shaft means to cause rotation of connected pairs of said shaft means; means for axially expanding and contracting said connecting shaft means; drive means connected to said driving shaft means for imparting rotary motion thereto; shifter means disposed to engage said scorer members, being mounted on said moving shaft means by being threadably engagable with each pair of moving shaft means said improvement comprising: said driving shaft means are defined by two shafts having guide rail means disposed in parallel therewith, and said shifter means each having a pair of elongated boss portions projecting therefrom and being in slidable engagement at the boss portions with lateral surfaces of said guide rail means, each boss portion being further defined by recess means at one end and projection means at the other end thereof.

* * * * *